United States Patent [19]

Cowley

[11] 3,933,487

[45] Jan. 20, 1976

[54] IMAGING COMPOSITION FOR PHOTOELECTROPHORETIC IMAGING SYSTEM

[75] Inventor: Robert L. Cowley, Rochester, N.Y.

[73] Assignee: Xerox Corporation, Stamford, Conn.

[22] Filed: Jan. 6, 1971

[21] Appl. No.: 104,337

[52] U.S. Cl. ..... 96/1 PE; 106/287 R; 106/287 S

[51] Int. Cl.[2] ..... G03G 17/04

[58] Field of Search ..... 96/1, 1.3, 1 PE; 204/181 PE; 117/37 LE; 252/62.1, 501.2; 106/14, 19, 26, 310, 287 R, 287 S

[56] References Cited

UNITED STATES PATENTS

| | | | |
|---|---|---|---|
| 2,890,174 | 6/1959 | Mayer | 252/62.1 |
| 2,892,730 | 6/1959 | Kloepfer | 106/20 X |
| 2,940,847 | 6/1960 | Kaprelian | 96/1.2 |
| 3,036,924 | 5/1962 | Newman | 106/26 X |
| 3,210,273 | 10/1965 | Taulli | 106/287 S |
| 3,384,566 | 5/1968 | Clark | 204/181 PE |
| 3,419,411 | 12/1968 | Wright | 117/37 LE |
| 3,507,679 | 4/1970 | Metcalfe et al. | 117/37 LE |

*Primary Examiner*—Charles E. Van Horn

*Attorney, Agent, or Firm*—James J. Ralabate; David C. Petre; Gaetano D. Maccarone

[57] ABSTRACT

A solid imaging ink-coated sheet for use in photoelectrophoretic imaging systems comprising a support substrate having adhered to a surface thereof a thin, solid layer of an imaging ink suspension. The imaging ink suspension comprises a plurality of photosensitive pigment particles and thixotropic additive particles dispersed in a carrier liquid.

11 Claims, 1 Drawing Figure

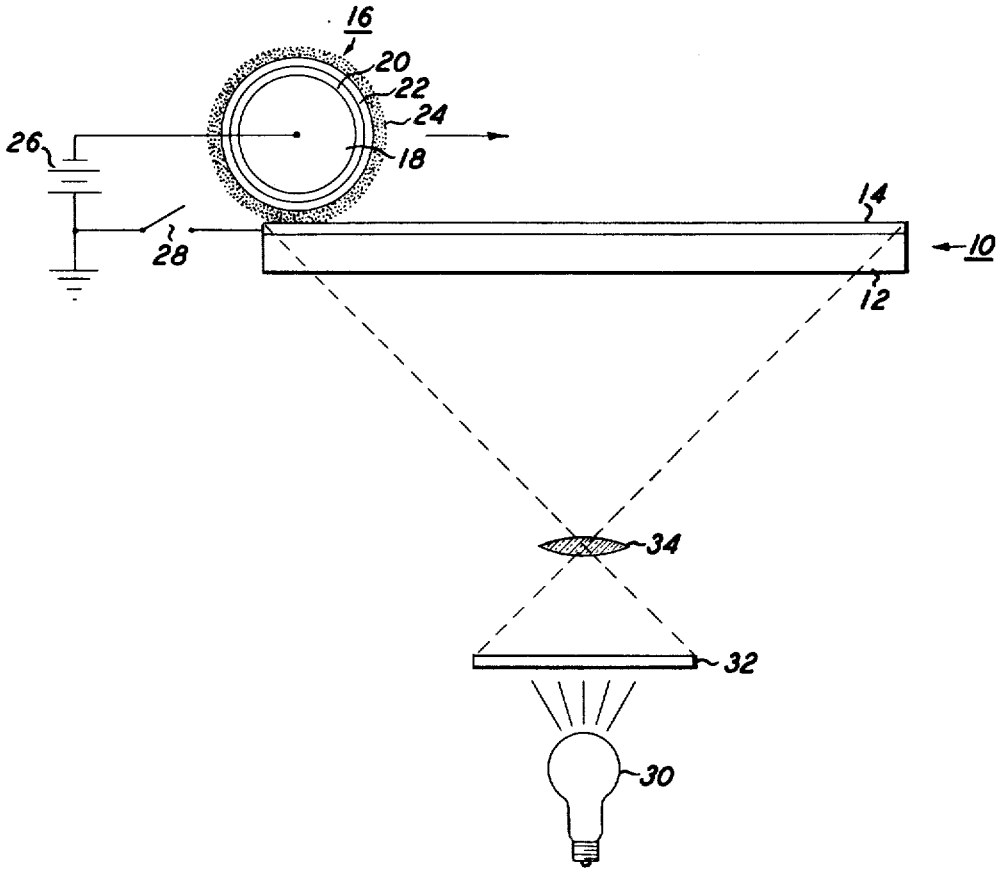
INVENTOR.
ROBERT L. COWLEY
BY F. D. Maccarone

IMAGING COMPOSITION FOR PHOTOELECTROPHORETIC IMAGING SYSTEM

BACKGROUND OF THE INVENTION

This invention relates to photoelectrophoretic imaging systems and more particularly to an imaging ink-coated donor sheet for use in such systems.

Photoelectrophoretic imaging in which electrically photosensitive particles are utilized to produce color images is a wellknown method. This process is described in detail and claimed in U.S. Pat. No. 3,384,565; U.S. Pat. No. 3,384,566; U.S. Pat. No. 3,383,993 and U.S. Pat. No. 3,384,488. In such an imaging system colored light absorbing particles are suspended in a carrier liquid. The suspension is placed between electrodes, one of which is preferably conductive and called the "injecting" electrode and one having an insulating layer on its surface and referred to as the "blocking" electrode, subjected to a potential difference and exposed to an image. As these steps are completed selective particle migration takes place in image configuration providing a visible image at one or both of the electrodes. An essential component of the system is the suspended colored particles which must be electrically photosensitive and which apparently undergo a net change in charge polarity upon exposure to activating electromagnetic radiation through interaction with one of the electrodes. In a monochromatic system a single colored image is produced equivalent to black and white photography. In a poly-chromatic system the images may be produced in natural color by providing a mixture of particles of two or more different colors which are each sensitive to light of a specific wavelength or narrow range of wavelengths. Particles used in this system must have both intense and pure colors and be highly electrically photosensitive.

In the above-described process the pigment particles are suspended in a carrier liquid and the suspension is coated on one of the electrodes before the imaging process takes place.

Coating of a thin liquid layer of the desired thickness from the suspension is difficult. Care must be exercised that excessive evaporation of the carrier liquid does not take place between the coating steps and the imaging steps. Storage of the suspension before use is a problem since the pigments may tend to settle out of the suspension. Also, pigments of different colors may not settle out at equal rates requiring careful stirring or resuspension of the pigments immediately before the coating step. Although when properly carried out, the process including the step of coating of the suspension onto an electrode immediately before imaging, is capable of producing images of excellent quality considerable attention must be directed to ensuring that the pigments are uniformly dispersed throughout the suspension when it is coated on the electrodes.

It would be desirable to have materials for photoelectrophoretic imaging whereby the imaging ink suspension can be prepared, then stored for relatively long periods of time and yet not require any reprocessing prior to subsequent use.

SUMMARY OF THE INVENTION

It is, therefore, an object of this invention to provide a photoelectrophoretic imaging system which provides the abovenoted desirable features.

It is another object of this invention to provide a photoelectrophoretic imaging system which does not require the steps of coating a pigment suspension onto an electrode immediately before imaging.

It is still another object of this invention to provide a simplified photoelectrophoretic imaging system.

It is yet another object of this invention to provide materials for photoelectrophoretic imaging processes which do not suffer degradation in storage.

The foregoing and other objects and advantages are realized in accordance with the present invention by providing a novel imaging ink-coated sheet for use in photoelectrophoretic imaging systems. The advantageous coated sheet of the invention comprises a thin support substrate having adhered to a surface thereof a thin layer of a dry (or solid) imaging ink suspension which comprises, generally speaking, a plurality of electrically photosensitive pigment particles and thixotropic additive particles in a carrier liquid. The thixotropic additive, when incorporated into a conventional imaging ink suspension comprising photosensitive pigment particles in a carrier liquid, results in the formation of a novel imaging suspension which has thixotropic characteristics, i.e., it is a dry composition when it is at rest but becomes fluid or semi-fluid when it is disturbed such as by the application of a shearing force thereto. This novel ink-coated sheet is utilized as or on one of the electrodes in the photoelectrophoretic imaging system. When a shearing force is applied to the imaging ink layer during the imaging process as will be explained in detail hereinafter, the suspension becomes semi-liquid or liquid thus allowing the pigment particles to migrate and form the desired image.

Thus, the novel imaging suspension may be prepared, applied to a support substrate while it is in a liquid state, and then allowed to coagulate to form a dry layer. The ink-coated sheet can then be stored and later subsequently used in a photoelectrophoretic imaging system without any further processing.

The invention will be more readily understood and appreciated from the following detailed description of various preferred embodiments thereof particularly when read in conjunction with the accompanying drawing which represents a side view of a simple exemplary system for the practice of photoelectrophoretic imaging utilizing the dry imaging ink-coated sheet of the invention.

Referring now to the FIGURE, there is seen a transparent electrode generally designated 10, which in this exemplary instance is a layer of optically transparent glass 12 overcoated with a thin optically transparent layer 14 of tin oxide. Tin oxide coated glass of this nature is commercially available under the tradename NESA glass from Pittsburgh Plate Glass Company. This electrode shall hereafter be referred to as the "injecting electrode." Adjacent to the injecting electrode 10 is a second electrode, generally designated 16, and hereafter referred to as the "blocking electrode." In this illustrative instance blocking electrode 16 is shown in the form of a roller having a conductive central core 18 surrounded by a layer of blocking material 20 which may be any suitable insulating material such as baryta paper. Attached to the outer surface of blocking material layer 20 is the novel imaging ink-coated sheet of the invention.

The ink-coated sheet is shown, for purposes of illustration, as a substrate 22 carrying a thin layer 24 of the advantageous imaging suspension of the invention which comprises a plurality of photosensitive pigment particles and thixotropic particle additives in a carrier liquid. The term "photosensitive" for purposes of this application refers to the properties of a particle which, once attracted to the injecting electrode, will migrate away from this electrode under the influence of an applied electric field when exposed to activating radiation. A further detailed explanation of the apparent mechanism of the photoelectrophoretic imaging system is disclosed in the above-mentioned patents. Although the ink-coated sheet is shown as being attached to the blocking electrode with the imagewise exposure step being carried out through the injecting electrode, it should be recognized that the imaging sheet can be placed on the injecting electrode and exposure carried out through the sheet in which case substrate 22 should be substantially transparent to the particular electromagnetic radiation employed for the imagewise illumination and typically should be a conductive material.

Blocking electrode 16 is connected to one side of potential source 26 is connected to switch 28 and injecting electrode 10 so that when switch 28 is closed an electric field is applied across the ink-coated sheet between electrodes 10 and 16. An image projector made up of light source 30, a transparency 32 and a lens 34 is provided to expose the photosensitive particles of ink layer 24 to a light and shadow pattern corresponding to the original image on transparency 32 to be reproduced.

Roller 16 is caused to roll across the top surface of injecting electrode 10 with switch 28 closed thereby applying a potential across the injecting and blocking electrodes. During the period when the roller is moved across the injecting electrode, imagewise exposure is carried out through the transparent injecting electrode. The shearing force exerted by the contact between the blocking and injecting electrodes causes the ink suspension layer 24 to become semi-liquid or liquid and consequently image formation occurs.

Two complementary images which are opposite in image sense to one another are formed on the electrodes. In this illustrative instance an image which is a duplicate in image sense to that carried by transparency 32 is formed on the injecting electrode and an image which is opposite in image sense to that carried by the transparency is formed on the donor sheet wrapped around the blocking electrode. The image on the injecting electrode can be removed therefrom and transferred to a final copy sheet by any suitable means. The image on the donor sheet may be fixed thereto by any suitable means to form a permanent reproduction. Where the donor sheet substrate is transparent it can be subsequently used as a transparency after the reproduced image has been fixed thereto. Any excess particles adhering to the surface of injecting electrode may be cleaned therefrom and the exposure step repeated if so desired. Additional exposure and cleaning steps have been found to increase the color purity and balance of the reproduced images. Optionally, a small amount of carrier liquid may be applied to the imaging ink layer before the roller electrode is rolled across the surface of the injecting electrode.

As discussed above the advantageous ink-coated sheet of the invention comprises a thin support substrate having adhered to a surface thereof a thin layer of imaging ink composition. The substrate may be of any suitable material and may have either electrically conductive or electrically insulating properties. Preferably the substrate is flexible whereby it may be wrapped around a circular electrode as has been illustrated. Moreover the substrate may be at least partially transparent whereby the imaging sheet can be attached to the transparent electrode and imagewise exposure carried out through the imaging sheet. When the substrate material has electrically insulating properties and is attached to the blocking electrode, the insulating substrate can serve as the blocking material layer for the electrode and a separate blocking material layer surrounding the conductive central core portion of the electrode is typically not required. Of course, where the substrate is electrically conductive and the imaging sheet is attached to the blocking electrode the electrode should typically have an outer layer of blocking material. Typical suitable substrate materials include, for example, bond paper; Tedlar, a polyvinylfluoride; Teflon, a polytetrafluoroethylene; Mylar, a polyethylene terephthalate; polypropylene and the like.

The novel dry imaging ink composition of the invention generally comprises a plurality of photosensitive pigment particles and thixotropic additive particles in a carrier liquid and is typically coated on a substrate material in a thickness of from about 10 to about 250 microns. The advantageous thixotropic additive incorporated in the imaging ink suspension can be any suitable material which imparts the desired thixotropic characteristics to the suspension, i.e., which when added to the suspension results in the formation of a dry composition capable of becoming semi-liquid or liquid upon the application of a source of disturbance such as a shearing force thereto. The novel imaging ink composition typically has a viscosity substantially higher than 10,000 centipoises in the dry state and from about 600 to about 1,000 centipoises during the time in which imaging occurs. The thixotropic additives may be organic materials, inorganic materials or mixtures thereof. Typical suitable thixotropic additive materials include, for example, inorganic compounds such as Cab-O-Sil (a colloidal silica available from G. L. Cabot, Inc.), Bentone 38 (a silicaceous compound probably based on a Bentone Clay and available from National Lead Co.) and the like; and organic compounds such as ethyl cellulose, collodion, etc.

The amount of thixotropic additive material typically required to impart the advantageous thixotropic properties to any imaging suspension will vary depending upon the particular additive employed in any instance and the other components of the imaging suspension. Generally, the thixotropic additive content may be from about 0.5% to about 10% or more by weight of the imaging composition. For optimum results, it is preferred to form an imaging suspension wherein the thixotropic additive is present in an amount of from about 1% to 3% by weight. The thixotropic additive material typically should not interfere with the passage of light through the imaging ink suspension and thus the additive is preferably white or transparent in that medium.

For better quality images, it is preferred to coat the support substrate with a thin layer of a release material prior to laying down the imaging suspension layer thereon. The release material allows the imaging suspension to separate from the substrate more easily during imaging thus permitting maximum color balance and density to be achieved in the reproduced images. Other additives such as plasticizers may also be incorporated in the imaging suspension.

The novel dry imaging ink-coated sheet of the invention is particularly adapted for use in a monochromatic photoelectrophoretic imaging system. Thus, the photosensitive particles included in the imaging suspension may be of a single color in which it is desired to produce the final image. Preferably the pigment particles have a spectral response in some region of the visible spectrum which can be matched by a convenient exposure source. Alternatively, the ink suspension may contain two or more different photosensitive particles of various colors which have substantially the same spectral response; or they have different ranges of spectral response. In a preferred embodiment of the invention the imaging suspension contains three differently colored photosensitive particles which are selected so that particles of different colors respond to different wavelengths in the visible spectrum corresponding to their principal absorption and further so that their spectral response curves do not have substantial overlap.

Any suitable electrically photosensitive particle or mixtures of such particles may be used in carrying out the invention, regardless of whether the particular particle selected is organic, inorganic and is made up of one or more components in solid solution or dispersed one in the other or whether the particles are made up of multiple layers of different materials. An extensive list of typical suitable pigments is given in U.S. Pat. No. 3,384,488 which is hereby incorporated by reference herein.

As stated above, any suitable particle structure may be employed. Typical particles include those which are made up of only the pure photosensitive material or a sensitized form thereof, solid solutions or dispersions of the photosensitive material in a matrix such as thermoplastic or thermosetting resins, copolymers of photosensitive pigments and organic monomers, multilayers of particles in which the photosensitive material is included in one of the layers and where other layers provide light filtering action in an outerlayer or a fusable or solvent softenable core of resin or a core of liquid such as dye or other marking material or a core of one photosensitive material coated with an overlayer of another photosensitive material to achieve broadened spectral response. Other photosensitive structures include solutions, dispersions, or copolymers of one photosensitive material in another with or without other photosensitively inert materials.

While the above structural and compositional variations are useful, it is preferred that each particle be primarily composed of an electrically photosensitive pigment, such as those referred to above, wherein the pigment is both the primary electrically photosensitive ingredient and the primary colorant for the particle. These particles have been found to give optimum photographic sensitivity and highest overall image quality in addition to being simple and economical to prepare. Of course, it may often be desirable to include other ingredients such as spectral or electrical sensitizers or secondary colorants and secondary electrically photosensitive materials.

The carrier liquid of the imaging suspension may be any suitable substantially insulating liquid. Typical suitable insulating carrier liquids include, decane, dodecane, N-tetradecane, Sohio Odorless Solvent No. 3440 (a kerosene fraction available from Standard Oil Co., of Ohio), Isopar G (a long chain saturated aliphatic hydrocarbon available from Humble Oil Co., of New York), molten paraffins, molten beeswax or other molten thermoplastic materials, silicone oils, fluorinated hydrocarbons, mineral oil, and mixtures thereof.

A wide range of voltages may be employed between the electrodes in this photoelectrophoretic imaging system. For good image resolution, high image density and low background it is preferred that the potential applied be such as to create an electric field of at least 300 volts per mil across the imaging suspension. The applied voltage necessary to attain this field strength will of course very depending upon the inter-electrode gap and/or the type and thickness of blocking material used on the blocking electrode surface. For the very highest image quality the optimum field is at least about 2000 volts per mil. The upper limit field strength is limited only by the breakdown potential of the imaging suspension and the material which forms the outer layer of the blocking electrode. Fields below about 300 volts per mil, while capable of producing images, generally produce images of low density across the image.

The invention will now be described in detail with respect to various specific preferred embodiments by way of Examples it being understood that there are intended to be illustrative only and the invention is not limited to the materials, procedures and conditions recitied therein. All parts and percentages listed are by weight unless otherwise specified.

EXAMPLE I

An imaging composition comprising a cyan pigment, Monolite Fast Blue, the alpha form of metal-free phthalocyanine available from Arnold Hoffman Co.; a magenta pigment, Watchung Red B, 1-(4'-methyl-5-chloroazobenzene-2'-sulfonic acid)-2-hydroxy-3-naphthoic acid available from E. I. duPont; and a yellow pigment N-2''-pyridyl-8,13-diozodinaphtho-(2,1-b; 2',3'-d)-furan-6-carboxamide, more fully described in U.S. Pat. No. 3,447,922 in Sohio Polychrome Ink available from Standard Oil of Ohio is prepared. The suspension contains about 10% by weight of pigment particles. About 4.4% by weight of a thixotropic additive, Bentone 38, a silicaceous compound available from National Lead Company, is added to the above-described suspension and the composition is ball milled for about 25 hours.

A sheet of Xerox 4024 bond paper is sprayed with a thin layer of Emralon 323, a polytetrafluoroethylene available from Acheson Colloids, and to the coated surface of the paper sheet is applied an approximately 100 micron thick layer of the imaging composition with a No. 3 wire coating rod. The coated sheet is allowed to stand until the imaging composition is dry. The paper substrate is then wrapped around the outer surface of a blocking electrode comprising solid metal core surrounded by an electrically conductive rubber roller and having an outer layer of approximately three mil thick Tedlar sheet. The conductive center of the blocking electrode is connected in series with a switch, a potential source and the NESA glass surface of a NESA glass injecting electrode.

The blocking electrode carrying the imaging ink-coated sheet is then rolled across the surface of the NESA glass electrode and a potential of 3000 volts DC is applied, the roller being made negative with respect to the NESA glass electrode. As the roller electrode is rolled across the surface of the NESA electrode the imaging ink composition is exposed through a neutral density step wedge transparency containing neutral density filters in the range of from 0.0 to 3.5 in 0.1 density increments. A positive image is formed on the NESA glass electrode and a negative image on the blocking electrode.

After the images are formed a second conductive roller having a 3 mil thick layer of Tedlar attached to its outer surface is rolled across the surface of the NESA glass electrode with the potential applied as described above. Subsequently, a third conductive roller having a sheet of paper attached to its outer periphery is rolled across the surface of the NESA glass electrode with a potential of 3000 volts DC being applied, in this instance the roller being made positive with respect to the NESA glass electrode thus transferring the image from the NESA glass electrode to the paper sheet. The images obtained are of good quality.

EXAMPLE II

The procedure followed in Example I is repeated. In this case the imaging suspension used has the same pigments and pigment concentration as that used in Example I with the exception that the carrier liquid is mineral oil. To the imaging suspension is added about 5.8% by weight of Cab-O-Sil, a colloidal silica available from G. L. Cabot. The composition is ball milled for about 24 hours.

A sheet of Xerox 4024 bond paper is sprayed with a thin layer of MS 122 a polytetrafluoroethylene available from Miller-Stephenson Co. and to the coated surface of the paper is applied an approximately 200 mil thick layer of the imaging ink composition with a No. 18 wire coating rod. Images of slightly lesser quality than those obtained in Example I are formed.

EXAMPLE III

The procedure used in Example II is repeated with the exception that a Tedlar substrate is used to support the imaging ink composition layer and no release agent is applied to the Tedlar before the ink layer is applied. An approximately 100 micron thick layer of the imaging ink composition is applied to the Tedlar sheet using a No. 3 wire coating rod. Images of comparable quality to those formed in Example I are obtained.

EXAMPLE IV

The imaging suspension of Example I is used and to it is added about 4.4% by weight of Bentone 38. The composition is ball milled about 24 hours. An approximately 200 micron thick layer of the imaging ink composition is applied to a surface of a sheet of Xerox 4024 bond paper, previously coated with a thin layer of Emralon 323 polytetrafluoroethylene, using a No. 18 wire coating rod.

The imaging procedure followed in Example I is repeated with the exception that the second roller step is eliminated. Images of higher density than those obtained in Example I are formed.

EXAMPLE V

The imaging suspension of Example I is used and to it is added about 1.1% by weight of Cab-O-Sil. The composition is ball milled for about twenty-four hours. An approximately 200 mil thick layer of the imaging composition is applied to a surface of a sheet of Xerox 4024 bond paper, previously coated with a thin layer of MS122 polytetrafluoroethylene, using a No. 18 wire coating rod.

The imaging procedure of Example IV is repeated with the images formed showing high contrast with relatively poorer background.

While the invention has been described in detail with respect to various embodiments thereof, it is not intended to be limited thereto but rather it will be appreciated by those skilled in the art that modifications and variations are possible which are within the spirit of the invention and the scope of the claims.

What is claimed is:

1. The method of photoelectrophoretic imaging comprising:

a. providing an imaging donor sheet comprising a substrate having adhered to a surface thereof a layer of an imaging composition, said imaging composition comprising a plurality of finely divided colored particles and from about 0.5% to about 10% by weight of thixotropic additive particles in a carrier liquid, each of said colored particles comprising an electrically photosensitive pigment, said imaging composition having a viscosity above about 10,000 centipoises when at rest;

b. providing first and second electrodes at least one of which is at least partially transparent;

c. attaching said imaging donor sheet to said first electrode with the free surface of said donor sheet substrate adjacent the outer surface of said first electrode;

d. contacting said imaging composition layer with the surface of said second electrode so as to apply a shearing force to said composition thereby reducing the viscosity of said composition to from about 600 to about 1000 centiposes; and e. substantially simultaneously exposing said imaging composition to an image through said at least partially transparent electrode with a source of activating radiation while subjecting said composition to an applied electric field whereby an image is formed.

2. The method as defined in claim 1 wherein said thixotropic additive particles represent from about 1% to about 3% by weight of said imaging composition.

3. The method as defined in claim 1 wherein said thixotropic additive particles comprise an inorganic material.

4. The method as defined in claim 3 wherein said thixotropic additive particles comprise colloidal silica particles.

5. The method as defined in claim 1 wherein said donor sheet substrate comprises an electrically insulating material.

6. The method as defined in claim 1 wherein said donor sheet substrate is at least partially transparent to said activating radiation and said donor sheet is attached to said at least partially transparent electrode.

7. The method as defined in claim 1 wherein said imaging donor sheet further includes a thin layer of a release material positioned between said substrate and said imaging composition layer.

8. The method as defined in claim 7 wherein said release material comprises polytetrafluoroethylene.

9. The method as defined in claim 1 and further including the step of transferring said image from the surface of at least one of said electrodes to the surface of a transfer member.

10. The method as defined in claim 1 wherein said electric field is applied while one of said electrodes is brought into rolling contact with the surface of said other electrode.

11. A method of photoelectrophoretic imaging comprising:

a. providing an imaging donor sheet comprising a substrate having adhered to a surface thereof a layer of an imaging composition, said imaging composition comprising a plurality of finely divided colored particles and from about 0.5% to about 10% by weight of thixotropic additive particles in a carrier liquid, said thixotropic additive being selected from the group consisting of colloidal silica, ethyl cellulose, collodion and mixtures thereof, each of said colored particles comprising an electrically photosensitive pigment, said imaging composition having a viscosity above about 10,000 centipoises when at rest;

b. providing first and second electrodes at least one of which is at least partially transparent;

c. attaching said imaging donor sheet to said first electrode with the free surface of said donor sheet substrate adjacent the outer surface of said first electrode;

d. contacting said imaging composition layer with the surface of said second electrode so as to apply a shearing force to said composition thereby reducing the viscosity of said composition to from about 600 to about 1000 centipoises; and e. substantially simultaneously exposing said imaging composition to an image through said at least partially transparent electrode with a source of activating radiation while subjecting said imaging composition to an applied electric field whereby an image is formed.

* * * * *